US005432539A

United States Patent [19]

Anderson

[11] Patent Number: 5,432,539

[45] Date of Patent: Jul. 11, 1995

[54] PRINTHEAD MAINTENANCE DEVICE FOR A FULL-WIDTH INK-JET PRINTER INCLUDING A WIPER ROTATED BY A LEAD SCREW

[75] Inventor: David G. Anderson, Ontario, N.Y.

[73] Assignee: Xerox Corporation, Stamford, Conn.

[21] Appl. No.: 316,294

[22] Filed: Sep. 30, 1994

Related U.S. Application Data

[63] Continuation of Ser. No. 48,599, Apr. 19, 1993, abandoned.

[51] Int. Cl.[6] ..... B41J 2/165

[52] U.S. Cl. ..... 347/33; 346/139 D

[58] Field of Search ..... 347/22, 32, 33; 346/139 D

[56] References Cited

U.S. PATENT DOCUMENTS

| | | | |
|---|---|---|---|
| 4,340,897 | 7/1982 | Miller | 346/140 R |
| 4,369,456 | 1/1983 | Cruz-Uribe et al. | 346/140 R |
| 4,401,990 | 8/1983 | Aiba et al. | 346/75 |
| 4,567,494 | 1/1986 | Taylor | 346/140 R |
| 4,814,794 | 3/1989 | Sato | 346/140 R |
| 4,829,318 | 5/1989 | Racicot et al. | 346/1.1 |
| 4,853,717 | 8/1989 | Harmon et al. | 346/140 R |
| 5,051,758 | 9/1991 | Markham | 346/140 R |
| 5,051,761 | 9/1991 | Fisher et al. | 347/33 X |
| 5,081,472 | 1/1992 | Fisher | 346/140 R |
| 5,084,712 | 1/1992 | Hock et al. | 346/1.1 |
| 5,103,244 | 4/1992 | Gast et al. | 346/1.1 |
| 5,115,250 | 5/1992 | Harmon et al. | 346/1.1 |
| 5,151,715 | 9/1992 | Ward et al. | 346/140 R |
| 5,184,147 | 2/1993 | MacLane et al. | 346/1.1 |
| 5,250,962 | 10/1993 | Fisher et al. | 346/140 R |

FOREIGN PATENT DOCUMENTS

| | | | |
|---|---|---|---|
| 3042998 | 7/1982 | Germany | B41J 3/04 |
| 0111751 | 5/1987 | Japan | B41J 3/04 |

*Primary Examiner*—Benjamin R. Fuller
*Assistant Examiner*—David Yockey
*Attorney, Agent, or Firm*—R. Hutter

[57] ABSTRACT

An ink-jet printer comprises a printhead including a front face defining an array of nozzle openings for the emission of ink droplets therethrough. A shuttle, including a wiper closely associated therewith, is disposed on a track adapted for the traveling of the shuttle through a fixed path generally parallel to the array. As the shuttle moves along the array, a mechanism including a lead screw causes the motion of the wiper against a portion of the front face of the printhead in a direction perpendicular to the direction of the array.

5 Claims, 2 Drawing Sheets

PRINTHEAD MAINTENANCE DEVICE FOR A FULL-WIDTH INK-JET PRINTER INCLUDING A WIPER ROTATED BY A LEAD SCREW

This is a continuation of application Ser. No. 08/048,599, filed Apr. 19, 1993 abandoned.

CROSS-REFERENCES TO RELATED APPLICATIONS

This application incorporates by reference co-pending patent application Ser. No. 08/047,931, entitled "Wet-Wipe Maintenance Device for a Full-Width Ink-Jet Printer," being filed concurrently herewith.

BACKGROUND OF THE INVENTION

1. Field of the Invention

The present invention relates to ink-jet printing, and is more particularly concerned with a simple but effective device for cleaning contaminants from a full-width array ink-jet printhead.

2. Description of Related Art

In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves across a print sheet numerous times in swaths, much like a typewriter; alternatively, a printhead which consists of an array of ejectors and extends the full width of the print sheet may be passed once down the print sheet to give full-page images, in what is known as a "full-width array" (FWA) printer. When the printhead and the print sheet are moved relative to each other, imagewise digital data is used to selectively activate the thermal energy generators in the printhead over time so that the desired image will be created on the print sheet.

With any kind of ink-jet printer in which a printhead is in close and extended contact with a substrate such as a sheet of paper with partially-dried ink thereon, an important practical concern is contamination of the area around the ejectors. External debris such as lint or stray paper fibers are likely to become caught in the small gap between the front face of the printhead and the sheet, possibly entering the nozzles of the ejectors and causing a failure of ejectors. Another cause of failure of individual ejectors is the fact that, if a particular ejector is not used for an appreciable length of time, even while the system is printing a document, a "viscous plug" of partially-dried ink will, in effect, cause a clot in the particular ejector, causing the ejector to fail at least temporarily, at least until the reheating of the particular ejector softens the viscous plug. A viscous plug often creates a partial blockage of an ejector, causing an ink droplet ejected therefrom to be misdirected. In ink-jet printers, a failure of even one ejector will have conspicuous results on a print, because the plugged ejector will leave a blank stripe across a printed area where the ink from the ejector should have been placed. Thus, the failure of even a very few ejectors in a system will render the entire system unsatisfactory to a demanding user. Therefore proper cleaning and maintenance of the area around the ejectors and between the ejectors and the substrate is of crucial importance to a practical ink-jet printer.

In the prior art there are various types of "maintenance station" for ensuring the proper functioning of a printhead, particularly those of the carriage-type variety. A typical configuration is to provide a maintenance station along the path of the moving printhead off to one side of where the sheet is located, so that, at the end of printing a sheet or at the end of a job, the printhead will slide into the head of the maintenance station and typically contact a member such as flexible blade which will have the effect of wiping any contaminants off the front face of the printhead.

U.S. Pat. No. 4,340,897 discloses a cleaning device for an ink-jet writing head wherein the nozzles of the writing head are urged into contact with a manifold having a set of brushes thereon. Vacuum is applied through the brushes to remove access ink from the nozzles.

U.S. Pat. No. 4,369,456 discloses a cleaning device for an ink-jet printer having a movable absorbent cleaning belt extending between two reels, which passes over the front faces of the ink-jet writing heads. The belt has defined therein a set of openings so that the writing head may be operated. Between jobs, the belt is advanced and embossed portions of the belt clean ink and impurities from the nozzle as the belt is indexed.

U.S. Pat. No. 4,401,990 discloses an ink-jet printer having a movable carriage traveling across the printing region. A nozzle for emitting ink droplets in a slidable member are disposed on the carriage. The slidable member includes a cleaning pad for cleaning the front surface of the nozzle. When the carriage is positioned at the end of the printing region, the slidable member is slid on the carriage so that the cleaning pad contacts the front surface of the nozzle.

U.S. Pat. No. 4,567,494 discloses an ink-jet printer, the nozzles of which are primed and cleaned after each print line by engaging the nozzles with an elastomeric suction cup. The suction cup includes an inner cup of foam which wipes of any residual ink droplets. The cup is connected to a vacuum pump for drawing ink out of the nozzles.

U.S. Pat. No. 4,814,794 discloses a cleaning device for the nozzle of an ink-jet printer, wherein cleaning liquid is supplied from a bag in a disposable cartridge and sprayed on the side of a nozzle in the printhead.

U.S. Pat. No. 4,829,318 discloses a maintenance system for purging and cleaning an ink-jet printhead, including a self-aligning purge nozzle which floats into positive engagement with a vent hole of the printhead, and a wiping roller, about which a tape of wiping cloth passes.

U.S. Pat. No. 4,853,717 discloses a maintenance station for an ink-jet printer comprising a pump for priming the printhead, and wiping means for cleaning the printhead. The wiper is stationary relative to the apparatus, so that when the printhead on a carriage passes across the wiper in the carriage motion, the wiper is moved across the front face of the printhead.

U.S. Pat. No. 5,051,758 discloses a rotary cleaning device for an ink-jet printer including a cylindrical supporting member having a flexible wiping blade which is rotated in the motion path of the printhead nozzles in a carriage-type ink-jet printer. At the end of a carriage motion, the rotatable member causes a helically-disposed wiper blade to slide against the nozzles of the printhead.

U.S. Pat. No. 5,081,472 discloses a cleaning device for a carriage-type ink-jet printer. The cleaning device comprises a rotatable drum having at least one slot in which an absorbent material covered with a mesh material is inserted. When the printhead is located by the cleaning station, the drum is rotated and the covered absorbent material wipes the nozzle face.

U.S. Pat. No. 5,084,712 discloses a maintenance system for an ink jet printer, including a solvent supply system for spraying solvent on the faces of the ink-jets and in the ink-jet openings, and a brush for scrubbing the ink-jet faces during and immediately after the spraying process. The solvent vapors enter the jets and deprime the jets so that the ink remaining in the jets drains out back into an ink reservoir.

U.S. Pat. No. 5,103,244 discloses an ink-jet printer cleaning system including a multi-blade wiper which is indexed automatically to permit each printhead in the apparatus to be wiped by a selected blade. This system is useful for color printing systems in which several printheads, each for a different color, are movable on a single carriage across the printing area. When the carriage contacts the end of the carriage path, the carriage engages a lever which causes indexing of the multi-blade wiper.

U.S. Pat. No 5,115,250 discloses a rotary wiper for use in a carriage-type ink-jet printer. The wiper includes a plurality of blades which successively wipe contaminants from the orifice played to the printhead during rotation of the wiper. The wiper is rotated by a motor or by a rack-and-pinion arrangement, in which the rack is disposed on the printhead carriage and actuates the wiper as the printhead moves into the surface station at the end of the printing area.

U.S. Pat. No. 5,151,715 discloses a printhead wiper for carriage-type ink-jet printers. The wiper is molded from an elastomer which stays in a stationary position while the printhead on the carriage moves passed it. As the printhead passes over the wiper, the wiper wipes the front face of the printhead.

U.S. Pat. No. 5,184,147 discloses an ink-jet printhead maintenance system having means for applying a vacuum to the ink-jet nozzles in the printhead. An elongated wiper engages and wipes the surface of the nozzles and is preferably moved at an extremely slow rate across the surface to enhance the wiping operation. A specialized drip edge is positioned beneath the orifice surface for directing drops of ink away from the ink-jet printhead which are generated during the cleaning procedure.

In a full-width array (FWA) printer, a generally different architecture is required to perform an effective cleaning of the printhead. Simply to wipe across the linear array in the direction the linear array is extending tends to be unsatisfactory because, with such a long wiping difference, contaminants removed from one end of the array will tend to be merely pushed to the nozzles on the other end of the array; i.e., with a long wiping distance, contaminants will tend to be simply moved from one ejector to another. What is needed is a maintenance station and FWA ink-jet printer which may rapidly clean across a long array without causing contaminants to be simply moved from one side of nozzles to another.

SUMMARY OF THE INVENTION

According to the present invention, there is provided an ink-jet printer comprising a printhead including a front face defining an array of nozzle openings for the emission of ink droplets therethrough. A shuttle, including a wiping member closely related thereto, is disposed on a track adapted for the traveling of the shuttle through a fixed path generally parallel to the array. As the shuttle moves along the array, a mechanism causes the motion of the wiping member against a portion of the front face of the printhead in a direction perpendicular to the direction of the array.

DESCRIPTION OF THE PREFERRED EMBODIMENTS

Figure 1:
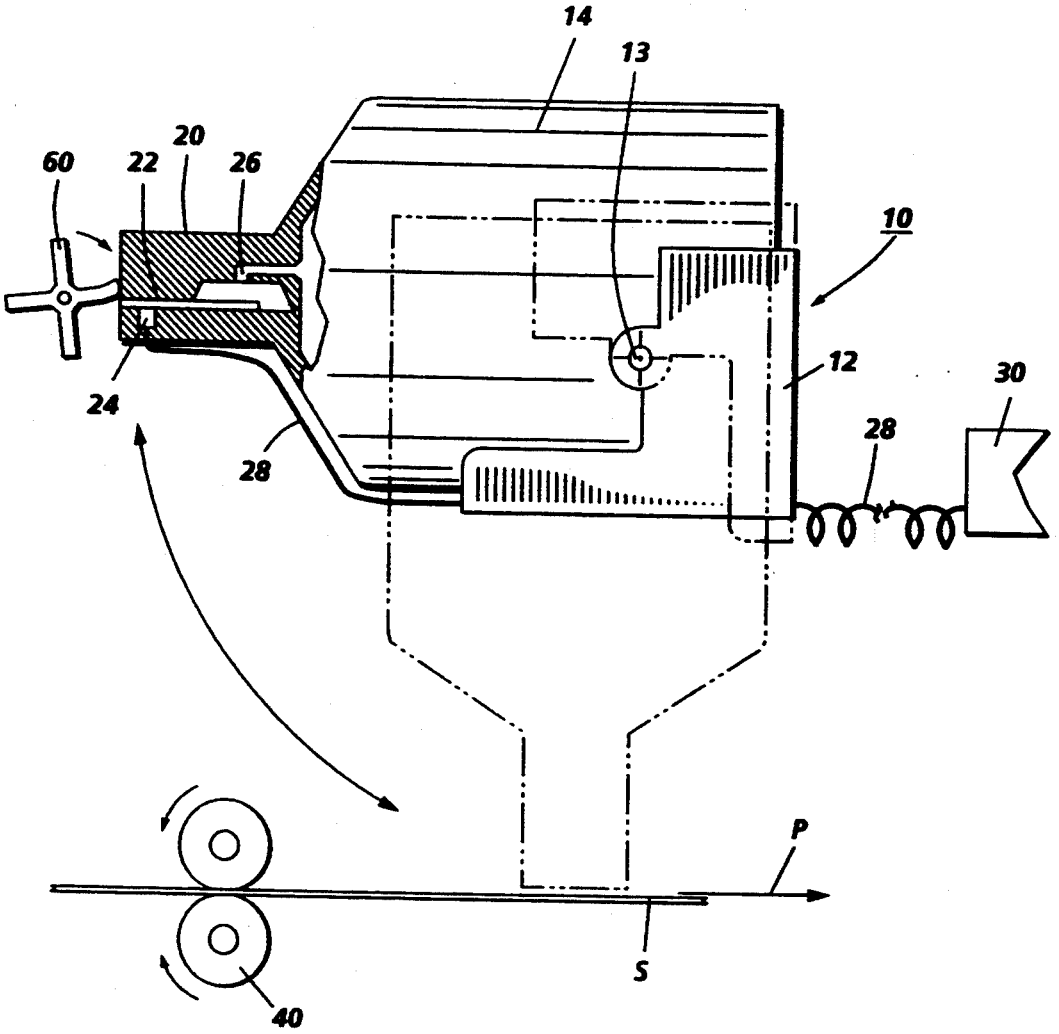
FIG. 1 is an elevational view showing the elements of a full-width array thermal ink-jet printer with which the present invention is suitable for use.

FIG. 1 is an elevational view showing a thermal ink-jet printer having a full-width linear array of ejectors which extend across the width of a sheet S moving through the system in process direction P. In the view of FIG. 1, the linear array of ejectors extends into the page. There is provided in this embodiment of the printer an ink supply cartridge generally indicated as 10, which is mounted on a carriage 12. The cartridge 10 is preferably removably mounted in carriage 12 for the replacement thereof when the ink in the cartridge 10 is expended. The bulk of cartridge 10 is an ink supply generally indicated as 14, which in the embodiment shown is of a single color in one chamber, but one skilled in the art will appreciate that multiple chambers may be provided within cartridge 10 to facilitate the supply of multiple colors to the printer. The other important portion of cartridge 10 is the printhead, generally indicated as 20. Printhead 20, in a full-width array printer, comprises at least one linear array of selectively-actuable ejectors (only one of which is shown in this end-on view) which are controlled by a series of leads thereto to a controller 30, which activate the various ejectors in printhead 20 in accordance with image data during the printing operation. Each ejector in printhead 20 includes an ink channel 22 which terminates in an opening at the outer portion of the printhead through which ink is ejected. Adjacent each channel 22 is a heating element 24 which, when voltage is introduced therein, causes the rapid heating of liquid ink in the channel 22, causing the liquid ink to be ejected out of the printhead 20 and onto the sheet. A new supply of ink is introduced into an individual channel 22 as needed through an ink supply manifold 26, which is connected through various means to one of any number of ink supply chambers in the ink supply 14, depending on the desired color of ink to be emitted from the particular channel 22. The various heating elements 24 for each ejector in the linear array are connected, by serial, parallel, or a combination of parallel and serial means, to a bus 28 which is ultimately connected to a controller 30 for the operation thereof to create an image on the sheet.

The embodiment shown in FIG. 1 shows the carriage 12 holding cartridge 10 in such a position that the cartridge 10 is in its non-printing or "maintenance" mode. This is the position of the cartridge 10 so that the printhead 20 thereof is not directed toward the sheet S, but rather directed away so that ink in any of the channels 22 will not leak onto the sheet or, if there is no sheet in the printer, into the machine in general when the system is idle. When printing is desired, carriage 12 pivots, as by pivot 13, to direct the printhead 20 toward the sheet S. During the printing operation, sheet S is typically moved in a continuous fashion across the printhead 20 by means such as rollers 40, actuated by a motor (not shown). Coordination of the operation of the printhead 20 by controller 30 with the position of the particular sheet S through the printer will be apparent to one skilled in the art.

Of course, if a multi-color printer is contemplated, there will typically be provided a plurality of parallel linear arrays of ejectors in the printhead 20, the ejectors in each array being connected to a particular color ink supply within the cartridge 10. Further, in various systems there may be provided multiple types of inks of the same color but of different drying rates, as would be required for a particular architecture. There may also be provided within the system, downstream of the printhead 20 in process direction P, any of various means to enhance or increase the rate of the drying of ink placed on the sheet, thereby to prevent smearing of the image as the sheet moves further along the system. Typical drying means may include convection or radiant heaters, a microwave device, or a light-flash device.

Figure 2:
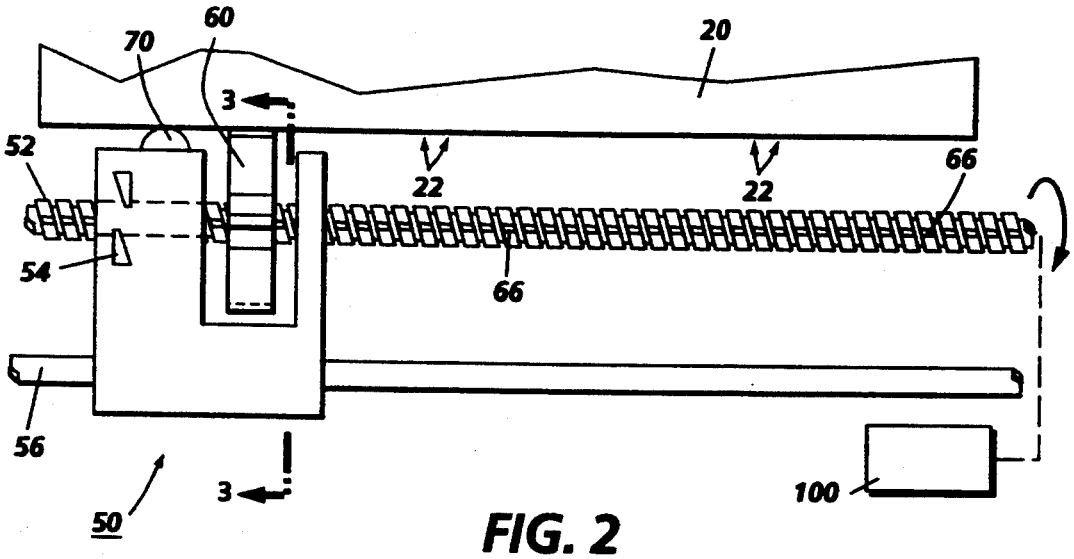
FIG. 2 is a plan view showing a portion of the maintenance device of the present invention interacting with the printhead of a full-width array ink-jet printer.

FIG. 2 is a plan view of the relevant portions of the printer, showing how a maintenance station of the present invention is used to clean the front face of printhead 20. The basic elements of the present invention include a shuttle generally indicated as 50, which travels along a rotating lead screw 52, which is typically caused to rotate axially by means of a motor 100. A tooth structure such as 54 is defined in the body of shuttle 50 to interact with the threading in lead screw 52 so that, when lead screw 52 is caused to rotate, shuttle 50 will be caused to move longitudinally along the lead screw 52, in a manner familiar to one skilled in the mechanical arts. Thus, because the lead screw 52 is in a position adjacent the front face of printhead 20 when the carriage 10 causes cartridge 10 to be in an idling or maintenance position, the traveling of shuttle 50 along lead screw 52 will be through a path which follows the linear array of the full-width printhead. An additional guide rail such as 56 may be incorporated to act with shuttle 50 to stabilize its motion along the printhead 20. Lead screw 52 and guide rail 56 can be said to form a "track" by which shuttle 50 may move in a controlled fashion along the linear array; as used in the specification and claims herein, a "track" describes any means along which the shuttle may travel in a fixed path relative to the printhead.

Closely associated with the shuttle 50 is a wiper 60. In the illustrated embodiment of FIG. 3, wiper 60 is in the form of a small hub with a plurality of flexible blades extending radially therefrom. Wiper blades 64 are preferably of a flexible plastic, such as an elastomer, which would be suitable for wiping the front face of a printhead 20. In the illustrated embodiment, wiper 60 is mounted directly on lead screw 53, as seen clearly in the cross-sectional view of FIG. 3, and rotates directly therewith. Preferably, lead screw 52 has defined therein a longitudinal slot 66, which enables the rotating lead screw 52 to "carry" the wiper 60, thereby causing the rotation thereof. The hub of wiper 60 preferably includes on an inner-facing portion a tab 68 which extends into slot 66, which may convey the rotational motion of lead screw 52. However, tab 68 should fit into longitudinal slot 66 in such a way that the wiper 60 is freely slidable longitudinally along the length of lead screw 52. That is, the arrangement should be such that wiper 60 is rigidly mounted on lead screw 52 for rotational motion, but freely slidable for longitudinal motion along lead screw 52. In this way, the rotation of lead screw 52 will cause the rotation of wiper 60 and, since the rotation of lead screw 52 also causes the longitudinal motion of shuttle 50, shuttle 50 will push along the wiper 60 so the the blades 64 will successively wipe against the front plate of printhead 20 particularly around the ejectors 22.

The advantage of the specific technique of wiping the front face of the printhead 20 is that the action of the blades 64 wipe the front face of printhead 20 in a direction perpendicular to the direction of the linear array, and also the direction of travel of the wiper 60. In this way, contaminants around the channels 22 are pushed away from the front face of printhead 20 right away, and not pushed along toward other nozzles, as would be the case if a single wiper blade were simply pulled across the entire printhead 20. In practice, it is generally not necessary that the debris on front face of printhead 20 be completely removed from the front face, as long as the contaminants are removed from the area immediately adjacent channels 22.

Preferred material for the mechanical parts of the present invention include an aluminum lead screw 52, preferably coated with NYTUF® anodized coating, and DELRIN A/F® low-energy coating for the portions of shuttle 50 in contact with the lead screw 52. Any type of resilient plastic usable for wiping purposes will be suitable for the wiper blades 64. The front face of printhead 20 which is wiped by blade 64 is preferably in the form of fluorinated DLC ("diamond-like coating"), which is a type of fluoride-carbon crystal structure known in the art.

In addition to the lead-screw arrangement of the illustrated embodiment of the present invention, other types of mechanisms may be contemplated to create the desired motion of the wiper against the front face of the preinthead. For example, a separate motor may be mounted on board the shuttle. The shuttle may be caused to move across the array by means of a pulley, and a gear arrangement may be provided on the shuttle to impart motion to the wiper. Other mechanisms will be apparent to one skilled in the relevant art.

Also associated with shuttle 50 in the illustrated embodiment of the invention is a follower 70, which is used to press against either the front face of printhead 20 itself, or some other structure adjacent the printhead, to ensure a consistent spacing of the wiper blades 64 from the front face of printhead 20. The follower may also include therein a vacuum nozzle, associated with suction means (not shown) for vacuum removal of debris, viscous plugs, and other contaminants from the front face of printhead 20. Also possible is the inclusion on shuttle 50 of a "wet-wiper," meaning a wick for the application of water or other solvent to the printhead face, to enhance the cleaning process. A more detailed discussion of a vacuum nozzle or a wet wiper which may be incorporated with the present invention may be found in co-pending patent application Ser. No. 08/047,931, entitled "Wet-Wipe Maintenance Device for a Full-Width Ink-Jet Printer," being filed concurrently herewith, and incorporated herein by reference.

In a preferred embodiment of the invention, after each page or after each multi-page job of printing is completed by the printer when the printhead 20 is in its active position (as shown in phantom in FIG. 1) the carriage 12 is caused to move upward so that the front face of printhead 20 is adjacent the wiper 60. In the cleaning process, lead screw 52 is rotated so that the wiper 60 mounted within shuttle 50 is caused to move across the front face of printhead 20. Further, by rotating lead screw 52 in one direction and then in the opposite direction, the wiper 60 may be moved across the printhead 20 twice in opposite directions, and also return to a "home position" off to one side of the printhead. In conjunction with the optional vacuum means on shuttle 50, a preferred routine for a cleaning operation is to first move the shuttle 50 in a direction from right to left in FIG. 2 operating only the wiper 60, and then moving the shuttle 50 from left to right while the vacuum is applied through the shuttle so that the vacuum follows the second wiping from the blades 64 on wiper 60.

Figure 3:
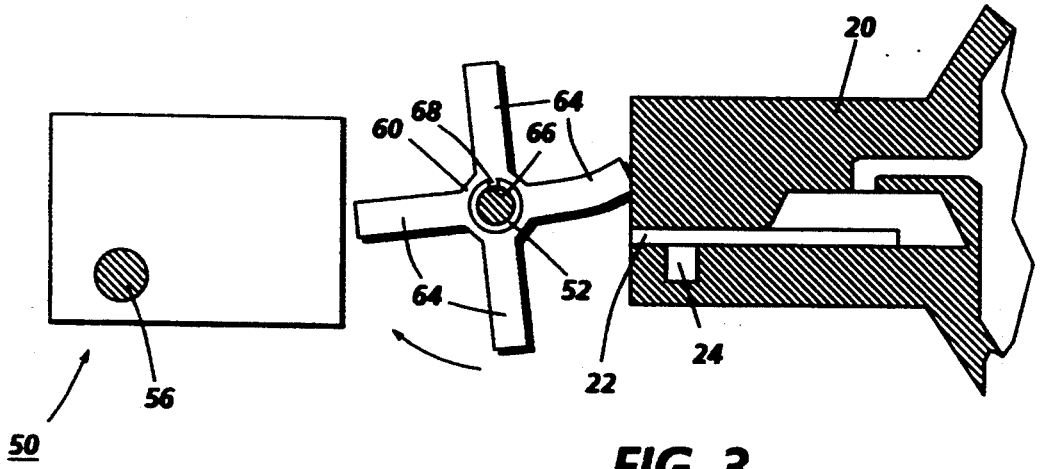
FIG. 3 is a sectional elevational view along the line in the direction of the arrows 3—3 of FIG. 2.
Figure 4:
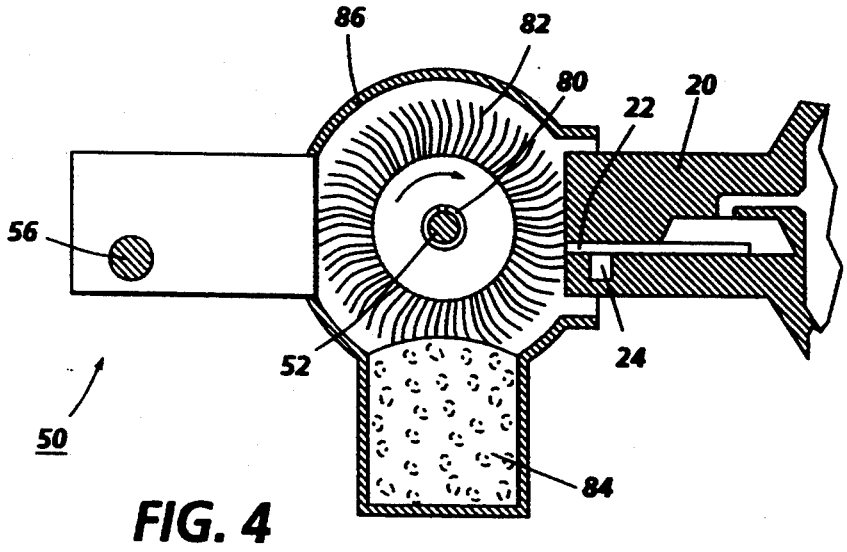
FIG. 4 a sectional elevational view similar to that of FIG. 3, showing an alternate embodiment of the present invention.

FIG. 4 is a sectional elevational view similar to FIG. 3, showing another variant of the present invention. Here, instead of providing a wiper 60 with flexible blades 64, there is provided on a rotatable wiper 80 having extending therefrom a relatively regular arrangement of brush filaments 82. These brush filaments 82 operate in the same manner as the blades 64, and are preferably made of thin, flat NYLON filaments. Further, there may also be provided adjacent the filaments 82 a solvent applicator such as 84, which is here in the form of a spongy wick. This wick 84 may be saturated with a solvent, which will be applied to the filaments 82, and then subsequently applied to the front face of printhead 20 as the system operates. In order to prevent splashing or wastage of solvent, it may be desirable to include a hood such as 86 over the rotating brush. Typically, in order to balance the needs of sufficient cleaning with avoiding damage to any coating on the front face of the printhead 20, the preferred solvent is either pure water with a small amount of biocide, or a substantially diluted detergent solution.

The pin 68 which fits into longitudinal slot 66 in lead screw 52 need not be made of a single piece with the rest of the wiper 60, but, alternately may be in the form of a separable pin made of a different material than the rest of wiper 60.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An ink-jet printer comprising:

a printhead including a surface, an array of nozzle openings defined in the surface, the array extending in a main direction, the nozzle openings being adapted for emitting ink droplets therethrough;

a lead screw including a helical groove and a longitudinal slot transfer to the helical groove, said lead screw being rotatable about an axis extending generally parallel to the main direction;

means for rotating the lead screw;

a shuttle and a wiper, each mounted movably on the lead screw, the shuttle being movable along a path generally parallel to the main direction of the array, the wiper being positioned to contact one of the nozzle openings and further including a pin fixedly mounted relative to the wiper and slidably journalled in the longitudinal slot;

a tooth fixedly mounted on the shuttle engaging the helical groove of the lead screw, whereby the shuttle is moved along the axis of the lead screw in response to the rotation of the lead screw; and a track disposed generally parallel to the array, the track supporting the shuttle for movement along the path generally parallel to the main direction of the array.

2. A printer as in claim 1, wherein the wiper comprises a hub.

3. A printer as in claim 2, wherein the wiper further comprises a plurality of flexible blades mounted on the hub.

4. A printer as in claim 1, wherein the wiper comprises a brush.

5. A printer as in claim 4, further comprising an applicator, mounted on the shuttle, for applying a liquid onto the brush.

* * * * *